United States Patent [19]

Bartow

[11] 4,356,891

[45] Nov. 2, 1982

[54] UPRIGHT FOR LIFT TRUCK

[75] Inventor: Richard J. Bartow, Athens, Mich.

[73] Assignee: Clark Equipment Company, Buchanan, Mich.

[21] Appl. No.: 28,308

[22] Filed: Apr. 9, 1979

Related U.S. Application Data

[63] Continuation-in-part of Ser. No. 17,779, Mar. 8, 1979, abandoned, which is a continuation-in-part of Ser. No. 842,765, Oct. 17, 1977, abandoned.

[51] Int. Cl.[3] ..... B66B 9/20

[52] U.S. Cl. ..... 187/9 E; 414/631

[58] Field of Search ..... 187/9 R, 9 E; 414/629, 414/630, 631, 641; 254/342, 389, 264, 394, 395

[56] References Cited

U.S. PATENT DOCUMENTS

| | | | |
|---|---|---|---|
| 2,642,157 | 6/1953 | Milz | 187/9 R |
| 2,770,324 | 11/1956 | Peterson | 187/34 |
| 3,263,777 | 8/1966 | Robichon | 187/9 R |
| 3,289,869 | 12/1966 | Hoyt | 187/9 E |
| 3,394,778 | 7/1968 | Brinton | 187/9 E |
| 3,587,784 | 6/1971 | Tait | 187/9 E |
| 3,830,342 | 8/1974 | Allen | 187/9 E |
| 3,968,859 | 7/1976 | Ehrhardt | 187/9 E |

FOREIGN PATENT DOCUMENTS

| | | | |
|---|---|---|---|
| 2020276 | 11/1971 | Fed. Rep. of Germany | 187/9 R |

*Primary Examiner*—Robert J. Spar

*Assistant Examiner*—Kenneth Noland

[57] ABSTRACT

A lift truck upright having a fixed upright section, a telescopic upright section, and a load carrier mounted on the latter section. A sole asymmetric lift cylinder assembly is located adjacent one side of the upright in a position which provides improved overall operator visibility through the upright. The lift cylinder is adapted to be operatively connected to the telescopic upright section by means of a pair of lifting chains. One of the chains is reeved on a pair of spaced and rotationally aligned sprockets supported either from the lift cylinder assembly and from the fixed upright section, or from the opposite ends of a transverse bar structure which is supported from the cylinder assembly. In either embodiment the one chain traverses the upright and is fixedly secured at one end at one side of the cylinder assembly and at the other end to the remote side of the telescopic section of the upright. The second chain is adapted to be reeved on a sprocket mounted from either the upper end of the lift cylinder assembly or from said transverse bar structure, the one chain end thereof being fixedly secured on the same one side of the lift cylinder as is the first chain, and the other end being secured to the near or adjacent side of the telescopic section.

A second centrally mounted cantilevered cylinder is mounted centrally of the telescopic upright section for elevating thereon the lifting carriage to a full free-lift position.

12 Claims, 9 Drawing Figures

UPRIGHT FOR LIFT TRUCK

CROSS-REFERENCE TO RELATED APPLICATIONS

This application is a continuation-in-part of copending application Ser. No. 17,779 filed Mar. 8, 1979, now abandoned which is a continuation-in-part of application Ser. No. 842,765 filed Oct. 17, 1977, now abandoned.

The present application is also related to copending application Ser. No. 202,099, filed Oct. 30, 1980, which is a continuation of said application Ser. No. 017,779. The present application is in addition related to my commonly assigned, copending, concurrently filed applications Ser. No. 28,292 and Ser. No. 28,614, and to application Ser. No. 176,742, filed Aug. 11, 1980, which is a continuation of Ser. No. 28,291, now abandoned.

BACKGROUND OF THE INVENTION

In lift trucks of the type contemplated it has been one of the most persistent problems encountered in the art over the years to provide an upright construction which both affords the operator of the truck good visibility through the upright and which is of relatively simple and low cost construction. Heretofore various means have been devised for improving operator visibility through telescopic uprights in lift trucks, including upright structures such as are disclosed in U.S. Pat. Nos. 2,394,458, 2,456,320, 2,642,157, 2,855,071, 3,394,778, 3,830,342, 3,968,859, and German Pat. Nos. 1,807,169 and 2,020,276, but none have satisfied adequately the above criteria.

SUMMARY

My present invention relates in part to an upright type known as a full free-lift two stage upright. It also relates to a unique asymmetric cylinder and reeving structure as between fixed and telescopic upright sections applicable to any multi-stage upright. It provides in such an upright significantly improved operator visibility and relative simplicity and low cost construction. More particularly, it provides an asymmetric lift cylinder assembly operatively connected to the telescopic upright section and located adjacent one side of the upright in such a manner that it projects at least partially into the area of interference by the adjacent side of the upright when in a retracted or collapsed position with the visibility of the operator from his normal line of sight through that side of the upright, and preferably it projects at least partially into the longitudinal plane of that side of the upright. The cylinder assembly operates two flexible lifting elements (chains), one of which is reeved to traverse across a portion of the upright on at least a pair of rotationally aligned spaced sprockets supported either from the lift cylinder assembly and from the fixed upright section, or from the opposite ends of a transverse bar structure which is supported from the cylinder assembly. In either embodiment the one chain traverses the upright and is fixedly secured at one end at one side of the cylinder assembly and at the other end to the remote side of the telescopic section of the upright. The second chain is adapted to be reeved on a sprocket mounted from either the upper end of the lift cylinder assembly or from said transverse bar structure, the one chain end thereof being fixedly secured on the same one side of the lift cylinder as is the first chain, and the other end being secured to the near or adjacent side of the telescopic section.

A cantilevered cylinder is mounted centrally of the telescopic section, and is adapted to elevate the load carrier to a full free-lift position on the telescopic section prior to the operation of the asymmetric cylinder.

It is a principle of the invention that the lifting force of the asymmetric cylinder and associated structure apply at least approximately balanced lifting force moments in the transverse plane of the upright of a full free-lift upright structure, while the structure also provides improved operator visibility through the upright.

An important object is to combine improved operator visibility in a full free-lift type of upright at relatively low cost and of relatively simple design.

Other objects, features and advantages of the invention will readily occur to persons skilled in the art from the detailed description of the invention which follows.

DESCRIPTION OF PREFERRED EMBODIMENT

Figure 1:
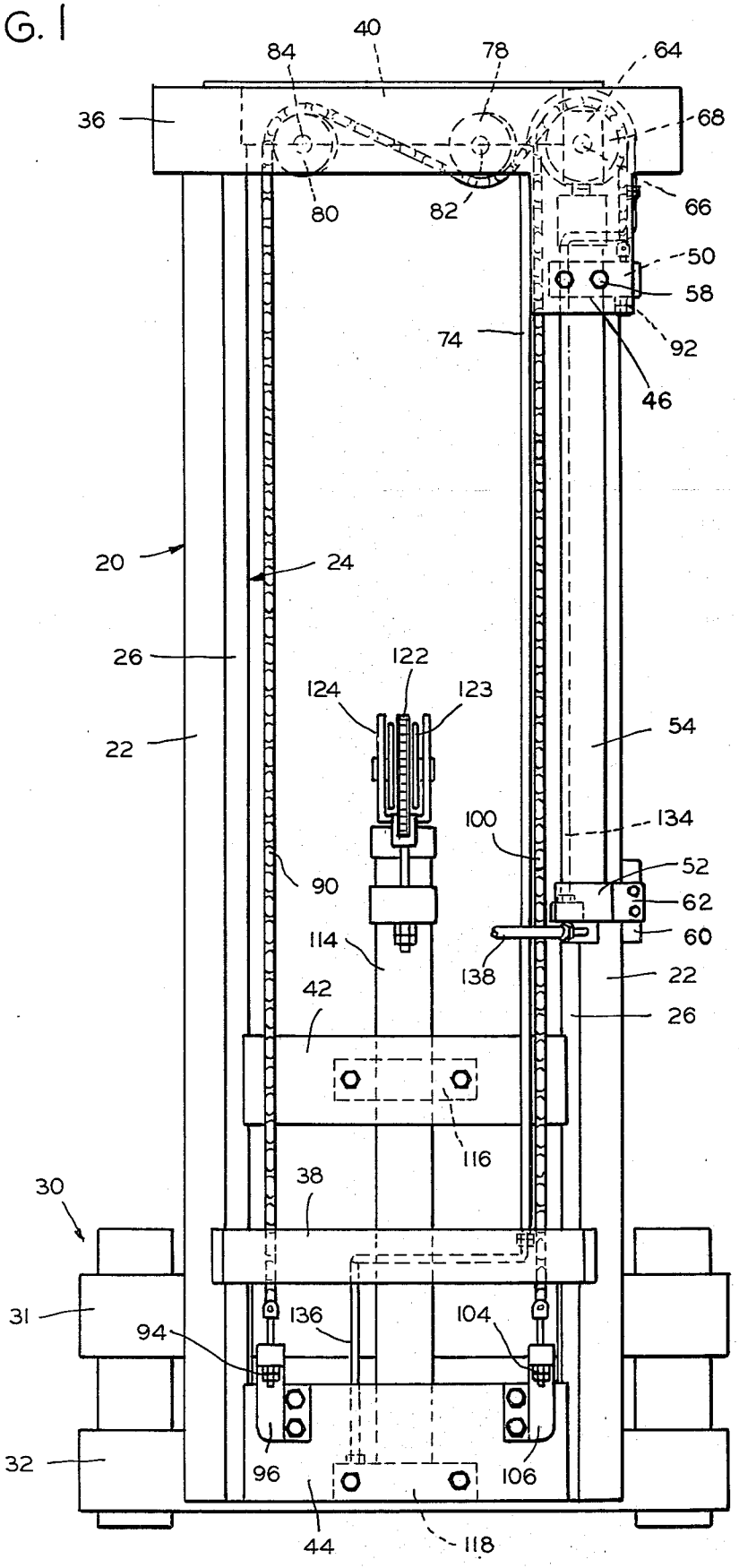
FIG. 1 is a full rear view of a lift truck upright in a collapsed position with the load carrier down.

Referring to the drawing, and first to FIGS. 1–4, the upright assembly of the present invention is adapted to be mounted on a lift truck in known manner, such as is shown in above application Ser. No. 202,099, now abandoned. A fixed mast section 20 includes a pair of transversely spaced opposed channel members 22 arranged to receive a single telescopic mast section 24 formed of two laterally spaced I-beams 26, mast section 24 being guide roller supported in mast section 20 and arranged for longitudinal movement relative thereto. A load or fork carrier 30 having a pair of transverse support plates 31 and 32 is guide roller mounted in known manner for elevation in the telescopic upright section. Mast section 20 is cross-braced for rigidity by means of upper and lower transverse brace members 36 and 38, and telescopic section 24 is cross-braced by upper, middle and lower transverse members 40,42 and 44. Brace 36 includes a downwardly extending support plate 46 adjacent the right side of the upright.

The I-beam mast section 24 is nested within the outer section 20 in known manner such that the forward flanges of the I-beams 26 are disposed outside of and overlapping the forward flanges of channels 22, and the rear flanges of the I-beams are disposed inside the adjacent channel portions and forwardly of the rear flanges of channels 22, pairs of rollers, not shown, being suitably mounted between said adjacent pairs of the I-beams and channels for supporting the I-beam telescopic section longitudinally and laterally for extensible movement relative to the fixed channel section. Particulars of the nested offset I-beam upright structure, the mounting of the load carrier thereon, and details of structure and mounting of guide and support roller pairs are explained in detail in U.S. Pat. No. 3,213,967.

As illustrated, a pair of vertically spaced plate members 50 and 52 are secured, as by welding, to one channel rail member 22 adjacent the upper and lower ends of an asymmetric cylinder 54 having a piston rod 56. The cylinder assembly is supported at an elevated position on rail 22 as shown. Bracket 50 is secured to support plate 46 by studs 58, and plate 52 is secured to rail 22 by a bracket 60 welded to the outer side of rail 22 and bolted to the bracket at 62. A bifurcated bracket 64 is mounted on top of piston rod 56 in which is mounted for rotation on shaft 66 a sprocket 68. A sheave 70 is mounted for rotation on a shaft, not shown, held in position by a nut 72 secured at the side of forward bifurcated element 64. The sheave is adapted to support a flexible hydraulic conduit or hose 74 which moves with elevation with sprocket 68 on the piston.

Figure 4:
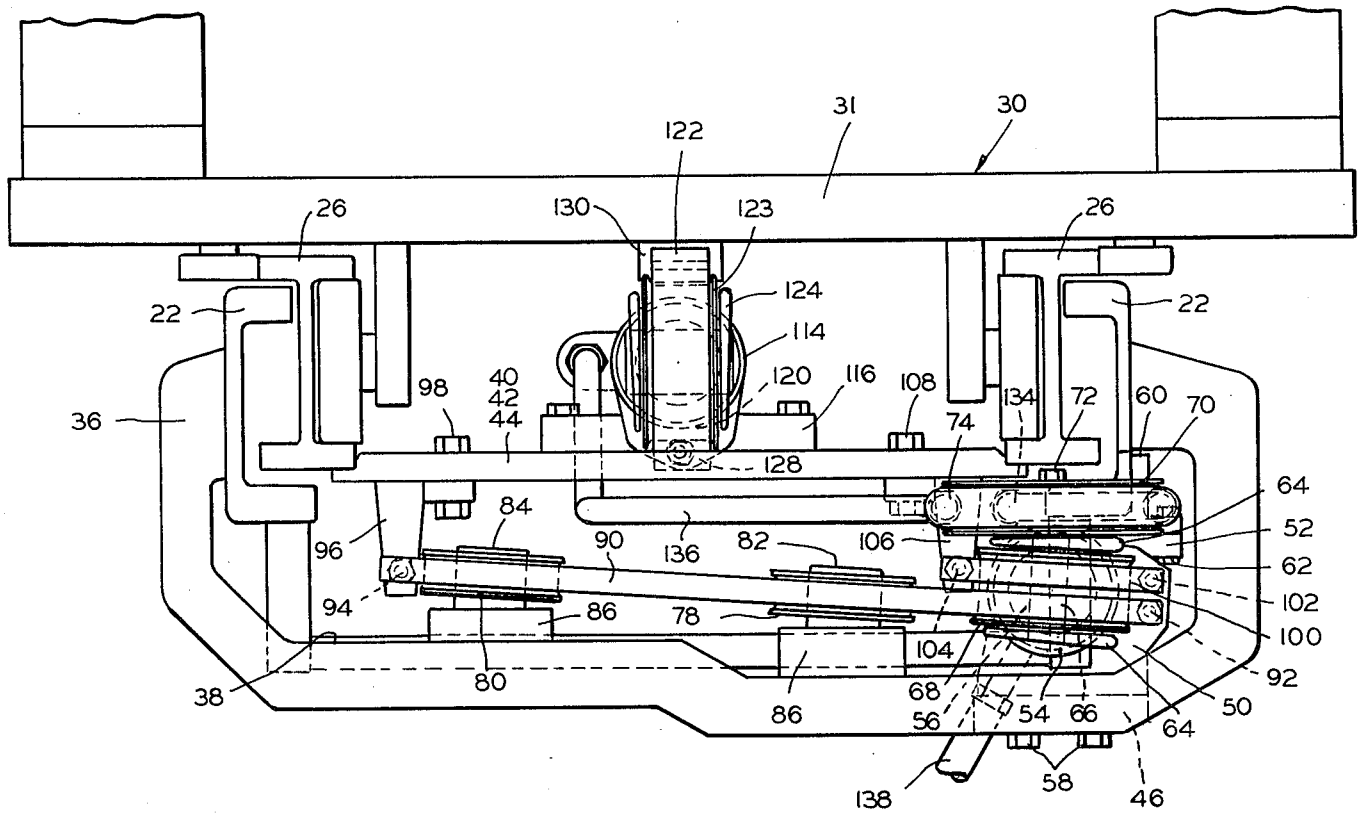
FIG. 4 is a plan view of the upright of FIG. 1.
Figure 5:
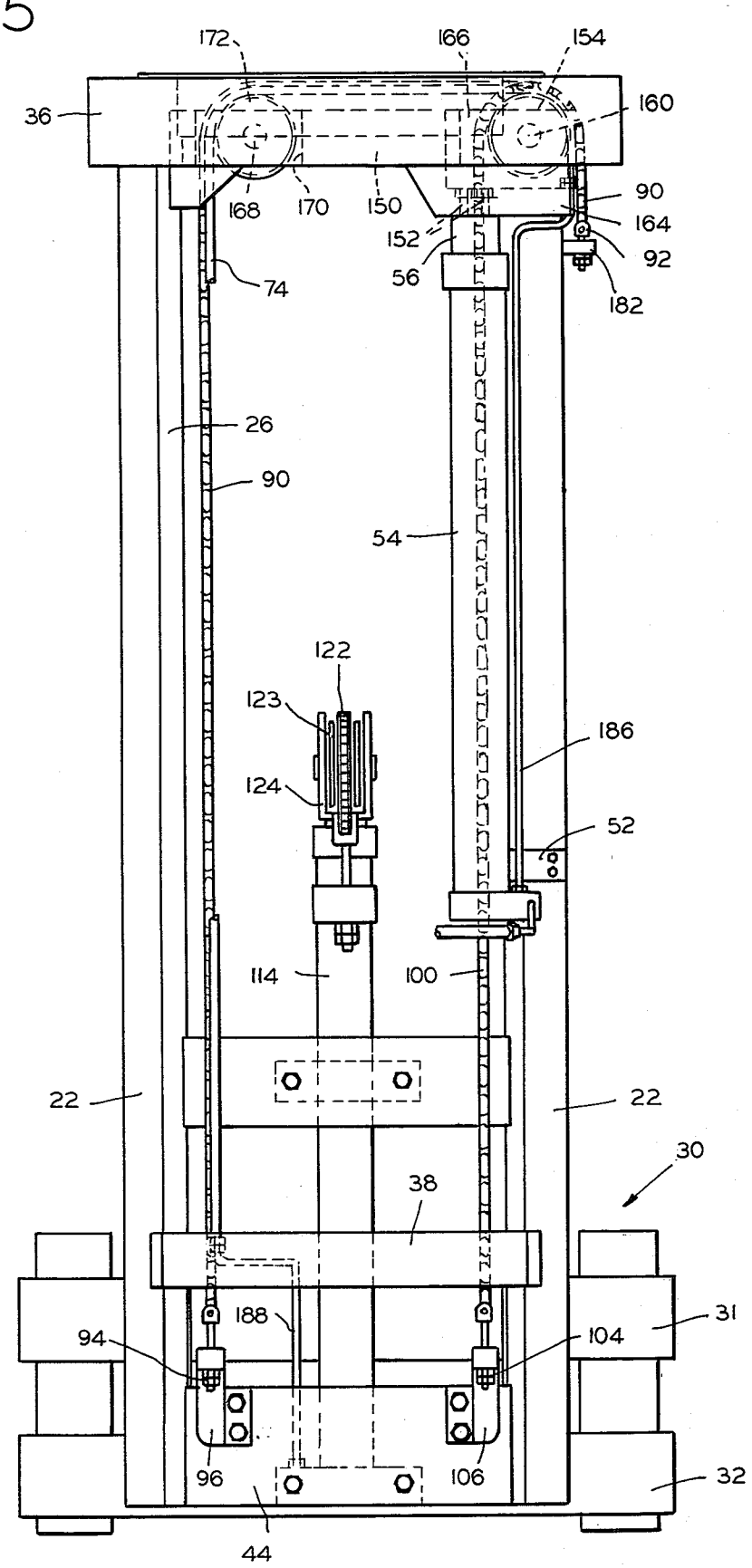
FIG. 5 is a rear view of a modification of the upright structure shown in FIG. 1.
Figure 6:
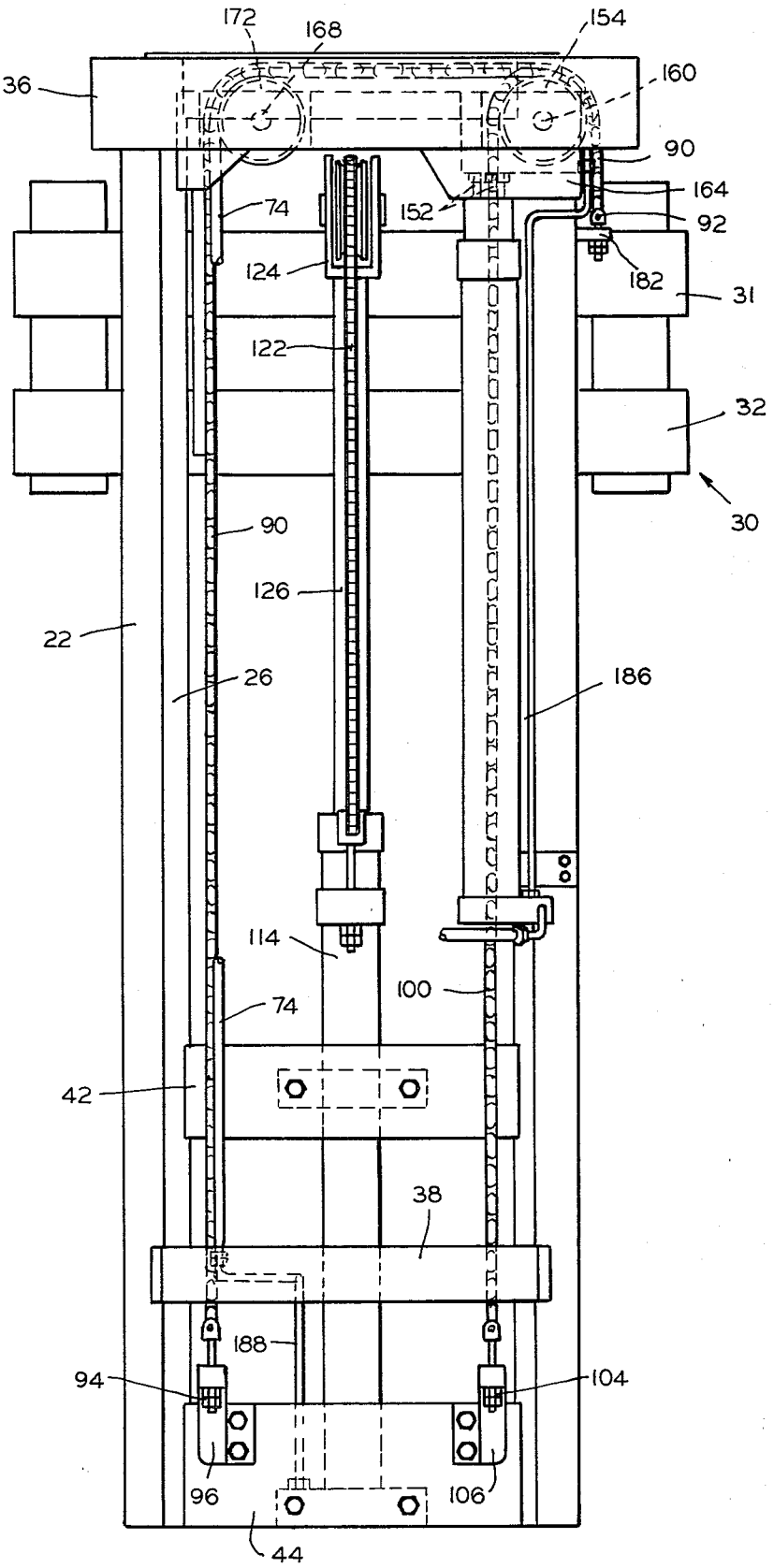
FIG. 6 is a view similar to FIG. 2, but of the modified upright structure.
Figure 7:
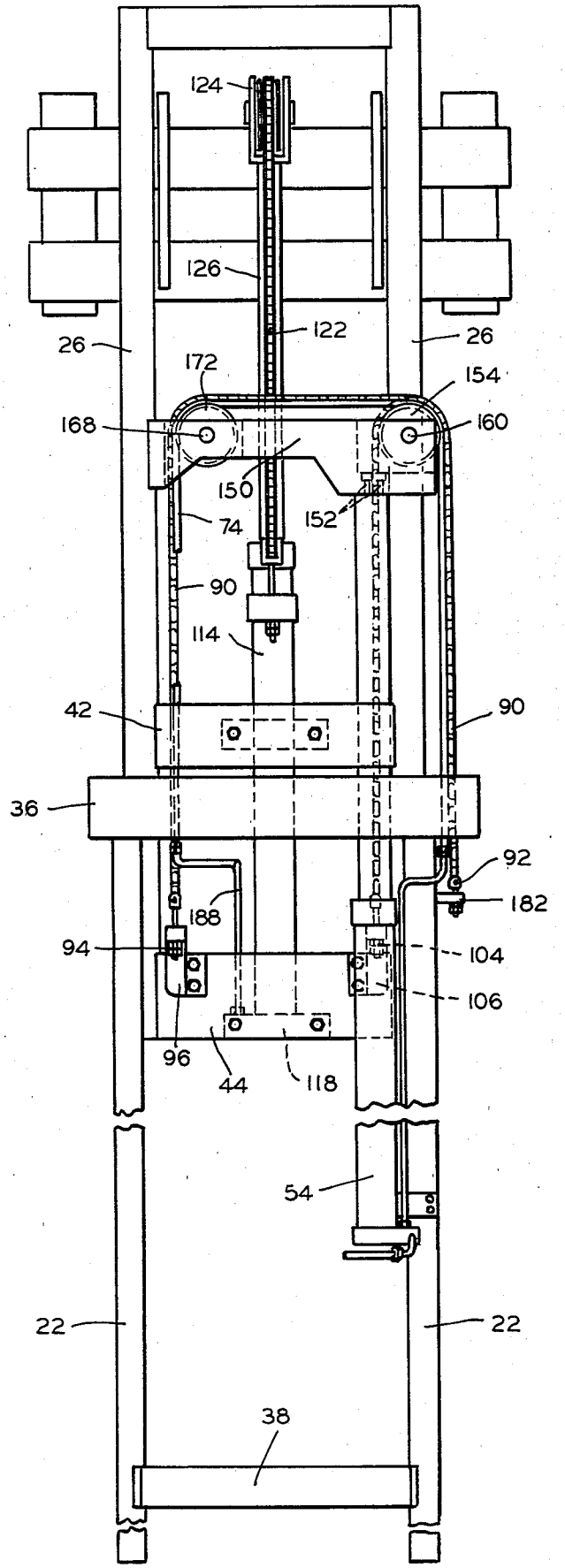
FIG. 7 is a view similar to FIG. 3, but of the modified upright structure.

A pair of spaced sprockets 78 and 80 are aligned transversely of the upright in a slightly biased position as shown in FIG. 4 in longitudinally aligned rotating relation with each other and with the sprocket 68, the sprockets being mounted for rotation on stub shafts 82 and 84 to outer brace 36 by mounting blocks 86. Sprocket 78 functions as an idler sprocket while sprockets 68 and 80 function as drive sprockets on which is reeved a chain 90 which is anchored at its one end adjacent the outer side of cylinder 54 at 92 and at its other end adjacent the opposite side of the upright by an anchor 94 to a bracket 96 which is secured to brace 44 of inner section 24 by bolts 98. A second chain 100 is reeved on the forward side portion of sheave 68, being anchored at its one end at 102 adjacent anchor 92, both of which latter anchors are secured to support plate 50, and is anchored at its other end at 104 adjacent the same side of the upright to brace 44 by a bracket 106 and bolts 108.

For convenience in the specification and claims hereof sprocket or sheave (wheel) means will on occasion be referred to as "sprocket" or "sprocket means", it being understood that any suitable wheel means for performing a similar function is intended to be included.

Figure 2:
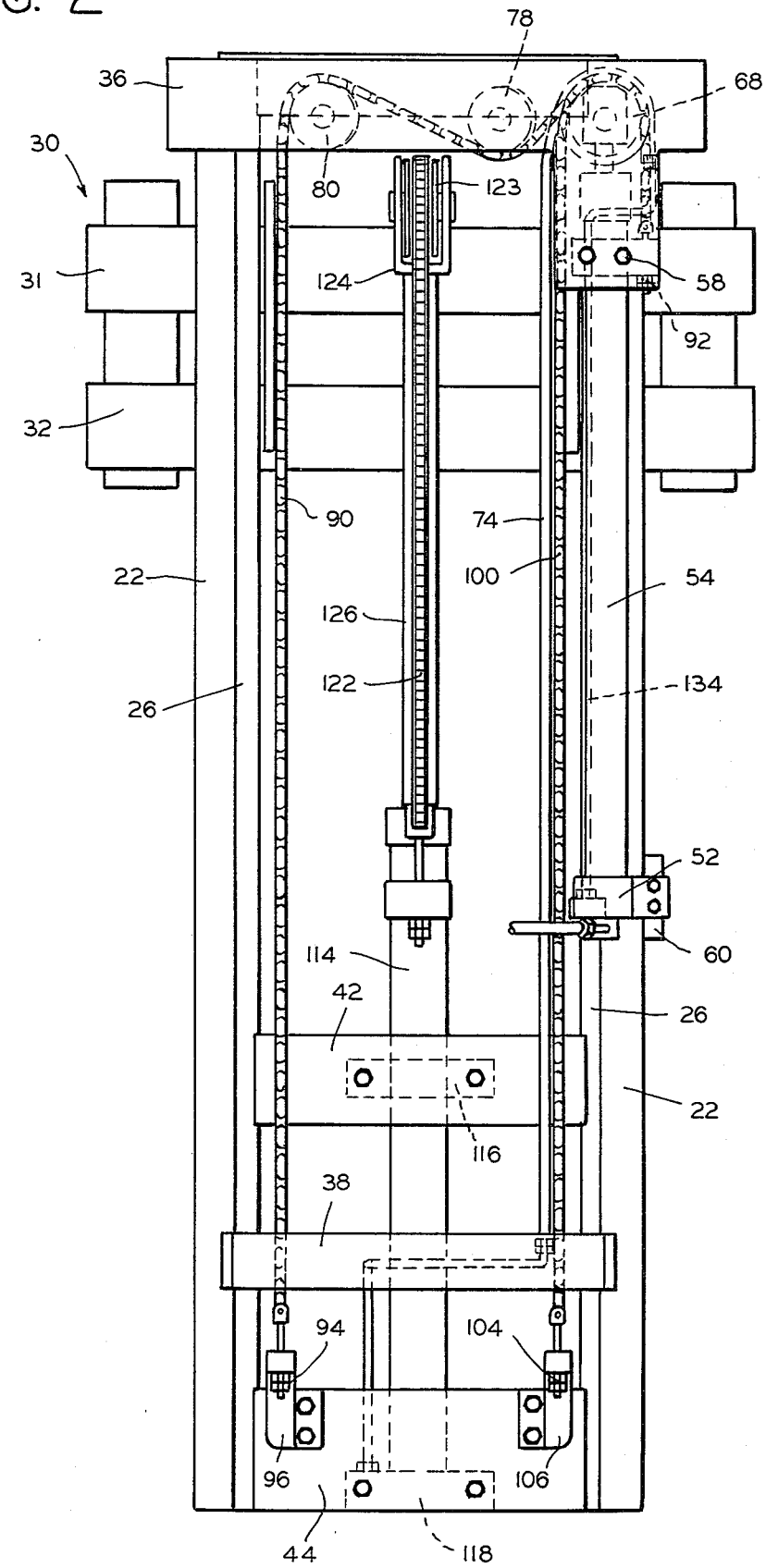
FIG. 2 is a view as shown in FIG. 1 with the load carrier shown in a full free-lift position at extension of the cantilevered cylinder.
Figure 3:
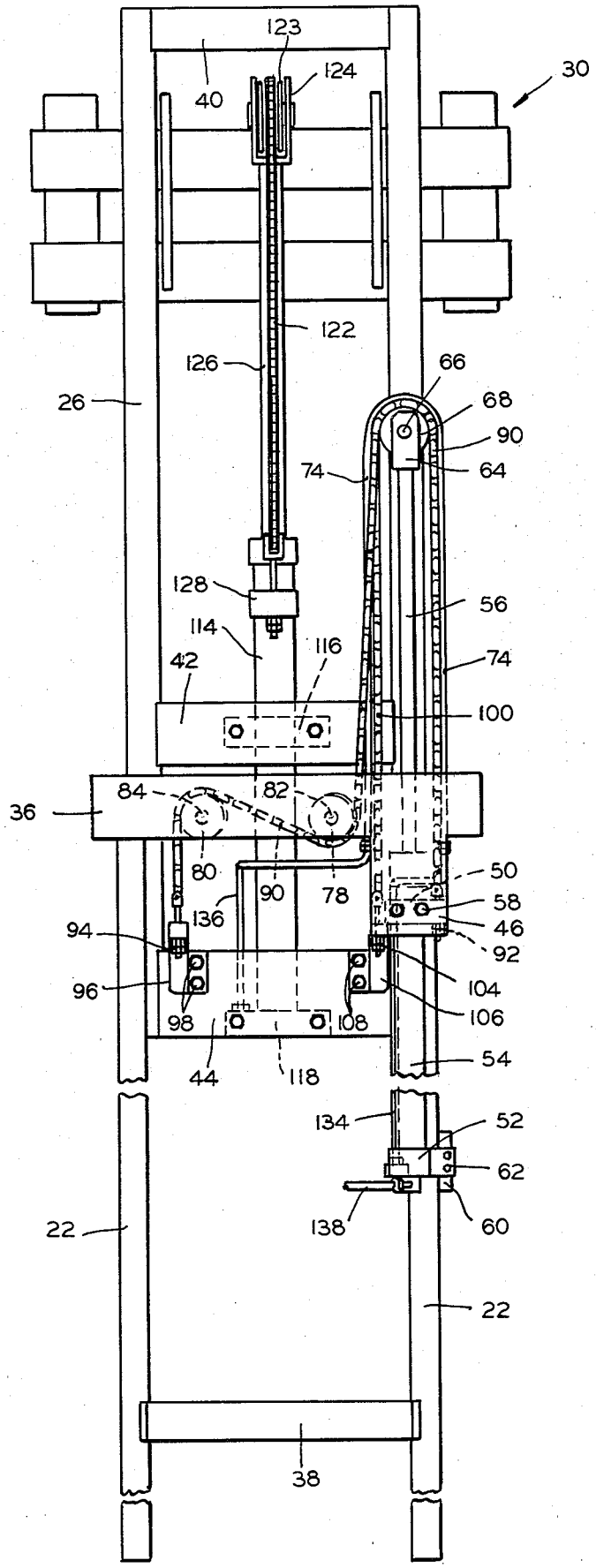
FIG. 3 is a rear view reduced in scale showing the upright extended to full elevation.

A cantilevered lift cylinder assembly 114 is supported centrally of upright section 24 on cantilevered support brackets 116 and 118 having central curved portions thereof, such as at 120 of member 116 secured to the cylinder as by welding, and being bolted as shown to braces 42 and 44, respectively, of inner section 24. A single sprocket 123 is mounted for rotation by a bifurcated bracket 124 at the end of a piston rod 126, lifting chain 122 being reeved on the sprocket and secured at one end to an anchor plate 128 located on the cylinder, and at the opposite end secured centrally of plate 32 of load carriage 30 at an anchor block 130. Both the asymmetric and cantilevered lift cylinder assemblies 54,56 and 114,126 are substantially one-half the length of the upright assembly when collapsed, and each is adapted to actuate the respective upright element at a 2:1 ratio, viz., cylinder 114 is adapted to operate the fork carriage first to the full free-lift position as shown in FIG. 2, subsequent to which the cylinder 54 actuates upright section 24 with the load carriage at full free-lift to full extension as shown in FIG. 3.

The hydraulic system is not shown except that the tube and flexible hose connected between the base ends of the cylinders are shown at 134 and 136 as connecting opposite ends of hose 74 and being connected to couplings in the cylinder base ends, a hose 138 being connected to a hydraulic system on the lift truck.

In this embodiment the basics of the reeving and chain end connections are different than in the modified embodiment described below and in the other of my copending applications referenced above, in that the location of the cylinder assembly 54,56 is not critical in relation to the location of chain anchors 92 and 102 and the central vertical plane of load carriage 30. This is because the asymmetric cylinder assembly is a "free-standing" cylinder not adapted to be connected to the inner section 24 by a pair of sprockets which are supported directly either from the end of the piston rod or from a telescopic section, but rather, as shown, the one sprocket 68 is connected on the piston rod and the other drive sprocket 80 is supported from fixed upright section 20. Anchors 92 and 102 may, therefore, be secured immediately adjacent cylinder 54 and need not be located substantially outwardly therefrom, as in the modified embodiment to be described below wherein the asymmetric cylinder is located intermediate the central vertical plane of the load carrier and the outer ends of the chains such that the projected or transverse distance from the central vertical plane of the load carrier to the axis of the cylinder is approximately equal to one-quarter the sum of the projected or transverse distances from the central vertical plane of the load carrier to the outer ends of the first and second chains. In the present embodiment a balanced upright is achieved in the transverse plane of the upright by locating the chain anchors 94 and 104 equidistant and on opposite sides of the central vertical plane of the upright section 24. The load carriage 30 is balanced in the upright, of course, because the cylinder assembly 114 is mounted centrally and has a single chain connection to the carriage. It is important to note that in such a construction it is quite feasible to locate the asymmetric cylinder substantially behind or in the longitudinal plane of the one side of the upright, as is apparent in the drawing, the longitudinal plane being defined as a vertical plane extending longitudinally of the upright assembly bounded by the outer and inner surfaces of the vertical rail assembly on the one side of the upright.

Referring now to the modified embodiment of my invention as shown in FIGS. 5–9, similar parts have been numbered the same as in FIGS. 1–4. The major design modification involves the provision of a sprocket support member which extends transversely of the upright, being supported from the piston rod of the asymmetric cylinder and guided from the inner upright section for movement relative thereto. In other words, none of the sprockets are mounted from the outer fixed upright section as in the embodiment of FIGS. 1–4, but all elevate with the asymmetric cylinder.

In the modification a transversely extending sprocket and sheave support and guide member 150 is mounted from the top of the piston rod 56 by a pair of recessed bolts 152 located at one side of the upright as shown. Cylinder 54 is supported at the bottom end by bracket 52,60 bolted to the rear flange of the one fixed rail 22 and welded to the cylinder barrel. The double sprocket 68 and an associated hose sheave 154 are mounted on a common shaft 160 which is supported from a bifurcated wide or thick end of member 150 in legs 162 and 164 thereof and which form in the end of member 150 an opening 166 for receiving the sprocket and sheave assembly. Sprocket 80 is mounted at the opposite and relatively thin end of member 150 on a shaft 168 in a slot 170, in common with a second sheave 172, member 150 extending transversely on a bias relative to the upright.

Chain 90 is reeved across the upright on the one side of sprocket 68 and on sprocket 80, being secured at its opposite ends to chain anchor 92 on an anchor block 182 which is secured to the outer side of the one fixed rail 22 and which is cantilevered rearwardly thereof from the upper end portion of the rail, the chain being secured at its opposite end to anchor 94 on anchor block 96 at the remote side of the lower transverse brace 44 of I-beam section 24. Chain 100 is reeved on the forward side of sprocket 68 between anchor 102 on anchor block 182 and to anchor 104 on anchor block 106, the chain extending through an opening 184 in member 150.

The hydraulic conduit 74 is reeved transversely of the upright on sheaves 154 and 172 in parallel with chain 90, being connected at its one end to tubing 186 which is connected to the base of cylinder 54 and at its opposite end to tubing 188 which is connected to the base of cylinder 114.

I-beam rails 26 of telescopic section 24 are formed with elongated inwardly extending rear flange portions 190 which are adapted to register with a pair of outwardly opening cleats 192 which are secured to the forward vertical surface of member 150 for connecting the latter member in transverse supporting and vertical guided relationship with the telescopic section.

In order to substantially balance the force moments acting in the transverse plane in the embodiment of FIGS. 5–9, the connections of chains 90 and 100 to anchors 94 and 104 should be approximately equally spaced on opposite sides of the central vertical plane of load carriage 30, the same as in the embodiment of FIGS. 1–4. However, whereas the location of the other chain anchors 92 and 102 in FIGS. 1–4 was not critical to a balance of that embodiment of the upright for the reasons stated, the location of anchors 92 and 102 in FIGS. 5–9 is critical in relation to the location of the connection of piston rod 56 to support and guide member 150. In order to balance the force moments acting in the transverse plane of the upright assembly it has been found that the location of the connection of piston rod 56 to member 150 should be at a position approximately one-quarter of the sum of the projected or transverse distances from the transverse center of load carriage 30 to the two chain anchors 92 and 102. It should be noted that the relative locations and spacing either longitudinally or transversely of the upright of the latter anchors may be varied to suit design requirements so long as the above distance relationship between the connection of the piston rod 56 to member 150 and the sum of the said transverse distances is maintained, whereby considerable design flexibility is possible in this respect.

In such a design the forces passing through upright sections 20 and 24 creates substantially no unbalanced moments or a calculated small unbalanced moment in the transverse plane of the upright. In an ideal design the upright functions in theoretical force moment balance, but such theoretical conditions do not ordinarily exist in practice, and side thrust or torque loading on the upright such as result from unbalanced moments effected by off-center loads on the fork, for example, may be resisted by upper and lower pairs of load carriage side thrust rollers 196 operating on the outer flange edges of I-beams 26 in known manner.

In operation of the embodiment of FIGS. 1–4, to elevate the upright from the position in FIG. 1 to that in FIG. 3, for example, pressure fluid is delivered by the hydraulic system simultaneously to cylinder assemblies 54 and 114 and, as is known, the cylinders operate automatically in a sequence related to the load supported thereby, whereby cylinder 114 functions initially to elevate load carriage 30 in the telescopic section to the full free-lift position illustrated in FIG. 2 at a 2:1 ratio to the movement of piston rod 126. At the end of this initial stage of operation the pressure fluid automatically sequences asymmetric cylinder 54 to elevate the telescopic section in fixed section 20 while the load carriage is maintained by primary cylinder 114 in the aforementioned full free-lift position; i.e., the connection via chains 90 and 100 to telescopic section 24 via sprocket 80 and the aligned side of sprocket 68 effects an elevation of the structure to the FIG. 3 position in a balanced mode of operation in the transverse plane of the upright. Lowering of the upright is effected by venting the cylinders to the fluid reservoir, whereby a reversal of the above-mentioned sequencing occurs as cylinder assembly 114 fully retracts to the position of FIG. 2, subsequent to which cylinder 54 retracts the load carriage to the FIG. 1 position.

The operation of FIGS. 5–9 is similar, except that the cylinder assembly 54 operates through support and guide member 150 carrying the main sprockets 68 and 80, along with the hydraulic conduit and sheaves 154 and 172, to effect guided movement relative to telescopic section 24 on I-beam flanges 190, the balancing of the upright in the transverse plane thereof being effected by the previously described design.

The designer of uprights of various widths, depths, seat locations, and the like may choose any one of a number of viable combinations of such structure within the scope of my invention. It should therefore be understood that recitations in the claims hereof relating to the substantial or approximate balance of force moments in the upright, or to the asymmetric position of the cylinder, particularly in respect of the embodiment in FIGS. 5–9, shall be interpreted to include a range of positions of the cylinder assembly between the sprockets which best effects the desired result of good operator visibility through the upright and adequately balanced force moments in the transverse plane of the upright acting on the upright in operation.

Figure 8:
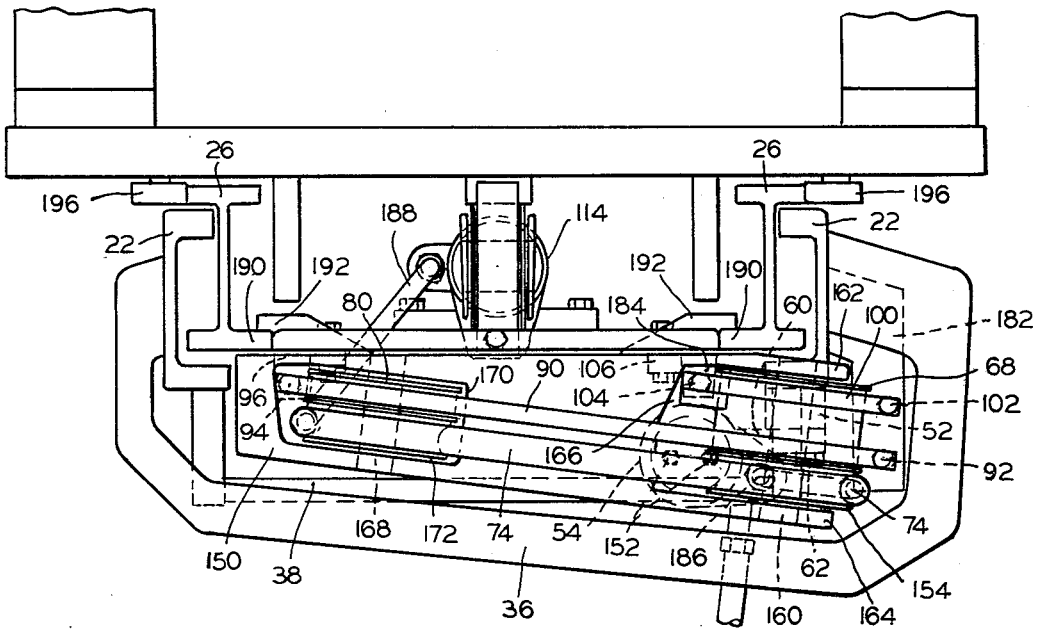
FIG. 8 is a view similar to FIG. 4, but of the modified upright structure.
Figure 9:
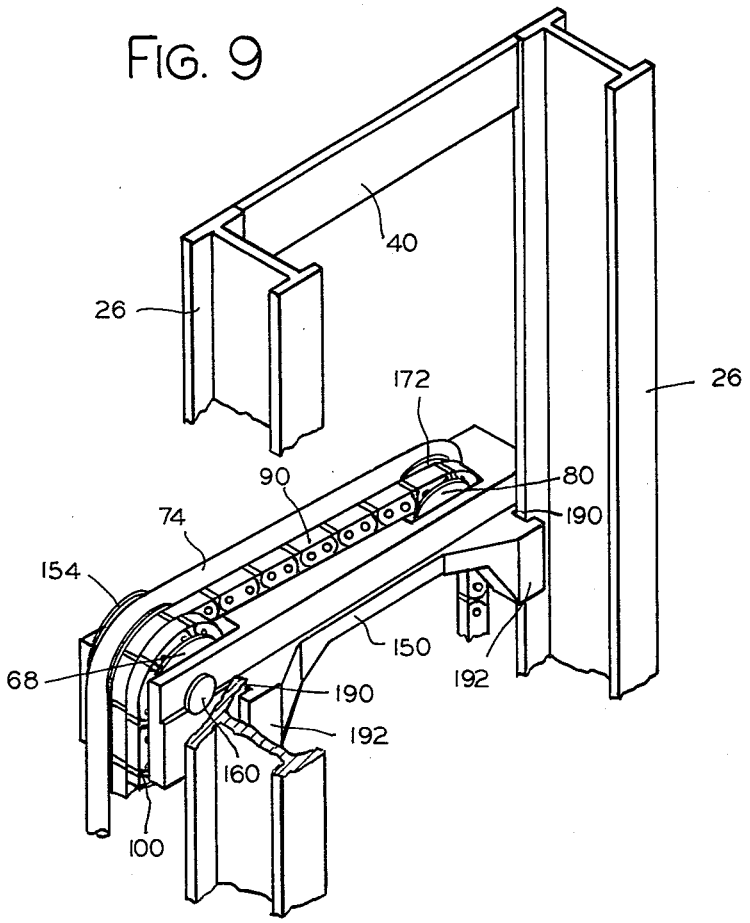
FIG. 9 is a view in perspective of a broken away portion of the modified structure.

The design is such that the location of the cylinder assembly at one side of the upright combines with the location of the operator, preferably off-set a predetermined distance to the opposite side of the longitudinal axis of the truck, to provide an operator's line of sight through the upright on the side at which the cylinder assembly is located so that the cylinder assembly interferes a relatively small amount with the operator's visibility through that side of the upright. In other words, the cylinder assembly projects at least partially into the area of interference by the adjacent side of the upright when in a retracted or collapsed position with the visibility of the operator from his normal line of sight through that side of the upright, and preferably projects at least partially into the longitudinal plane of that side of the upright, as is shown in FIGS. 4 and 8.

It will be understood by persons skilled in the art that many other design variations in the upright designs than those identified above may be found feasible without departing from the scope of my invention. For example, although the basic design of the upright as disclosed is of the offset I-beam roller mounted type, which is preferred, it will be appreciated that the invention may be also used with many other known upright types, including coplanar (not offset) roller mounted channels or I-beams, fully nested roller mounted I-beams inside of outer channels, non-roller mounted sliding inner channel in outer channel, a telescopic upright section mounted outwardly of an inner mounted fixed upright section, and the like.

The location of the fixed chain anchors 92 and 102 may be varied, such as at different selected vertical locations on the outer rail, or located on a cantilevered anchor support which may be secured to the asymmetric cylinder, particularly in the embodiment of FIGS. 5–9. It may be found advantageous in some designs to mount the asymmetric cylinder assemblies so that the cylinder 54 elevates on a fixed piston rod 56, in known manner; i.e., by reversing the position of the assemblies as shown and utilizing the piston rod also with the pressure fluid conduit to the cylinder to be actuated.

Depending upon such things as the axial distance to the operator from the upright, the width of the upright, or the transverse position of the operator when seated or standing in a normal operating position on different lift truck types, the most desirable precise location of the asymmetric cylinder assembly based upon the various factors will be established. As noted previously the most critical combination of factors affecting the selection of cylinder location is operator visibility and (particularly in FIGS. 5–9) force moment balance on the upright, both of which may be compromised from the ideal within the scope of my invention as required to effect the most desirable combination.

In a relatively wide upright, for example, and with the operator located relatively close to the upright in a forward direction and well off-center to the left thereof, it may be found advantageous to locate the cylinder further forwardly than is shown necessitating a relocation thereof leftwardly and completely out of the longitudinal plane of the right side of the upright.

It is noteworthy to identify the particulars of the chain reeving and the location of the asymmetric cylinder assembly particularly as in FIGS. 1–4 in respect of the fixed and telescopic upright sections per se. The novelty in the subcombination here noted relates to the structure best observed in FIGS. 3 and 4 wherein chain 90 is reeved from outer anchor 92 to anchor 94 at the remote side of telescopic section 24 via rotationally aligned sprockets 68,78 and 80, the latter two being mounted from the fixed upright section, and chain 100 is reeved from an adjacent outer anchor 102 to anchor 104 at the adjacent side of the telescopic section via the forwardly offset one side portion of sprocket 68. The anchors 94 and 104 are located substantially equidistant and on opposite sides of the longitudinal central vertical plane of the telescopic section. It is desirable in this subcombination that the cylinder assembly be always located at least partially in the longitudinal plane of the one side of the upright.

It should also be noted that one or more additional telescopic upright sections may be mounted from telescopic section 24 and elevated therewith by the reeving of one or more secondary chain and sprocket means connected between successive upright sections, such as is shown in my above identified copending application Ser. No. 176,742 now abandoned, in FIG. 1 at chains 110, 112 and the associated sprockets. A previously known method of so reeving successive upright sections is disclosed in the multi-stage upright of U.S. Pat. No. 2,877,868.

It will be understood by persons skilled in the art that modifications may be made in the structure, form, and relative arrangement of parts without departing from the spirit and scope of the invention. Accordingly, I intend to cover by the appended claims all such modifications which properly fall within the scope of my invention.

I claim:

1. In an upright structure for lift trucks and the like having a fixed upright section including transversely spaced vertical rails, a sole telescopic upright section including transversely spaced vertical rails mounted for elevation on said fixed section and elevatable load carrier means mounted for elevation on said telescopic section, the improvement comprising a sole asymmetric lift cylinder assembly mounted in the upright structure which is operatively connected to said telescopic section and which is supported from the fixed upright section at an elevated position and at one side thereof, first and second flexible lifting elements reeved on first and second wheel means and operatively connected to said cylinder assembly and to said fixed and telescopic upright sections, one end of each flexible lifting element being secured outwardly of one side only of the cylinder assembly, the other end of the first flexible lifting element being secured to said telescopic section adjacent the adjacent side of the upright and the other end of the second flexible lifting element being secured to said telescopic section adjacent the opposite side of the upright, said other ends of said first and second flexible lifting elements being secured at locations substantially equidistant and on opposite sides of the longitudinal central vertical plane of the load carrier, said cylinder assembly together with said first and second flexible lifting elements being adapted to elevate said telescopic section relative to said fixed section, the lift cylinder being located substantially at one side of the upright structure such that it projects at least partially into the area of interference by an adjacent vertical rail with the visibility of the operator from his normal line of sight through said adjacent vertical rail, and a second cylinder assembly for elevating said load carrier on said telescopic section independently of the elevation of said telescopic section on said fixed section by said asymmetric cylinder assembly, said first and second cylinder assemblies each having an effective stroke which is equal to approximately one-half the height of the collapsed upright structure.

2. An upright structure as claimed in claim 1 wherein said asymmetric cylinder assembly projects into at least a portion of the longitudinal plane of an adjacent vertical rail on the said one side of the upright structure.

3. An upright structure as claimed in claim 1 wherein inverted U-shaped conduit means connects hydraulically the base ends of the asymmetric and second lift cylinder assemblies, said conduit means being supported from the upper end of the asymmetric cylinder assembly and being located adjacent one side only of the visibility window of the upright.

4. An upright structure as claimed in claim 1 wherein said first flexible lifting element is reeved on a single main wheel element and said second flexible lifting element is reeved on a pair of transversely spaced main wheel elements which are mounted in substantial longitudinal rotating alignment.

5. An upright structure as claimed in claim 4 wherein one of said pair of wheel elements is mounted from the piston rod of the asymmetric cylinder assembly and the second of said pair of wheel elements is mounted adjacent the opposite side of said fixed upright section.

6. An upright structure as claimed in claim 5 wherein an idler wheel element is mounted from the fixed upright section intermediate the said pair of wheel elements and in longitudinal rotating alignment therewith.

7. An upright structure as claimed in claim 4 wherein a wheel element supporting guide member extends transversely of the upright and supports adjacent the opposite ends thereof said pair of wheel elements and is supported from the piston rod of the asymmetric cylinder assembly, said transverse guide member being guided for relative movement in relation to the telescopic section.

8. An upright structure as claimed in claim 4 wherein the asymmetric lift cylinder is connected to a member extending transversely of the upright which is operatively connected at its opposite ends to the spaced vertical rails of the telescopic section, said pair of wheel elements being supported from opposite sides of said latter member.

9. An upright structure as claimed in claim 8 wherein said transverse member extends transversely on a bias to the upright between the vertical rails of said telescopic section providing a relatively wide end portion at one side for mounting said first wheel element and one of said pair of wheel elements and a relatively narrow end portion at the other side for mounting said other of said pair of wheel elements.

10. An upright structure as claimed in claims 1 or 8 wherein said asymmetric cylinder assembly is located intermediate the longitudinal central vertical plane of the load carrier and the said one ends of the first and second flexible lifting elements such that the projected or transverse distance from said central plane of the load carrier to the axis of the asymmetric cylinder assembly is approximately equal to one-quarter of the sum of the projected or transverse distances from said central plane to the said one ends of said first and second flexible lifting elements.

11. An upright structure as claimed in claim 4 wherein said single and pair of wheel elements and said first and second flexible lifting elements are mounted on a bias transversely of the upright structure.

12. An upright structure as claimed in claim 4 wherein inverted U-shaped hydraulic conduit means is mounted adjacent said single and one of the pair of wheel elements and follows generally the path of said first flexible lifting element at the one side of the upright, said conduit means being also supported from the extensible end of the cylinder assembly.

* * * * *